US006409031B1

(12) United States Patent
Wynne

(10) Patent No.: US 6,409,031 B1
(45) Date of Patent: Jun. 25, 2002

(54) CEILING MOUNTED RACK

(75) Inventor: Dean Wynne, Hickory Hills, IL (US)

(73) Assignee: Folding Guard Company, Chicago, IL (US)

( * ) Notice: Subject to any disclaimer, the term of this patent is extended or adjusted under 35 U.S.C. 154(b) by 0 days.

(21) Appl. No.: 09/653,106

(22) Filed: Aug. 31, 2000

(51) Int. Cl.[7] ..... A47F 5/00

(52) U.S. Cl. ..... 211/119; 211/175; 211/181.1; 108/181

(58) Field of Search ..... 211/181.1, 119, 211/153, 90.03, 118, 175; 108/181

(56) References Cited

U.S. PATENT DOCUMENTS

| | | | | |
|---|---|---|---|---|
| 803,274 A | * | 10/1905 | Deaver | |
| 1,946,711 A | * | 2/1934 | Quisenberry | |
| 2,919,816 A | * | 1/1960 | Maslow | |
| 2,970,702 A | * | 2/1961 | Maslow | |
| 3,589,746 A | * | 6/1971 | Inglis | |
| 3,839,834 A | | 10/1974 | Goddard | 52/238 |
| 4,064,994 A | * | 12/1977 | Ondrasik | 211/153 |
| 4,157,070 A | * | 6/1979 | Huempfner et al. | |
| 5,027,959 A | * | 7/1991 | Luukkonen | 211/181.1 X |
| 5,379,564 A | | 1/1995 | Wynne | 52/458 |
| 5,542,530 A | * | 8/1996 | Freelander | 211/118 X |
| 6,016,928 A | * | 1/2000 | Cothran et al. | 211/183 |
| 6,079,575 A | * | 6/2000 | Wang | 211/181.1 X |
| 6,189,527 B1 | * | 2/2001 | Walsh et al. | 211/181.1 |

* cited by examiner

*Primary Examiner*—Robert W. Gibson, Jr.
(74) *Attorney, Agent, or Firm*—Garrettson Ellis; Seyfarth Shaw

(57) ABSTRACT

A rack comprises at least one wire mesh panel comprising a first array of parallel wires and a second array of parallel wires, the wires of the first and second arrays being in transverse, angular relation and being bonded to each other at at least a substantial number of wire crossing points. The panel defines opposed, parallel side edges which are substantially defined by first individual wires of the first array. Third wires are respectively bonded to the panel and positioned parallel to and adjacent to the first individual wires of the first array. The third wires are spaced from the first individual wires by crossing wires of the second array. A plurality of such wire mesh panels may be secured together at their opposed parallel edges by clamp members to provide a modular rack system. Hanger wires may be carried by clamp members, each end of the hanger wires defining a transversely (upwardly) extending wire portion terminating in a hanger hook so that the rack may be hung from a site above the rack.

14 Claims, 1 Drawing Sheet

3
3

CEILING MOUNTED RACK

BACKGROUND OF THE INVENTION

This invention relates to a rack which is mounted typically from a rafter, which may also hold a solid ceiling, or may be open. The rack is made of a mesh of stiff wires, and may comprise a group of modular units which may be secured together to provide a rack or racks of varying size. The entire rack system may be pre-assembled and lifted for easy installation into pre-installed attachment members. The system is very flexible and forgiving as to the spacing of the pre-installed attachment members. Also, the system will tend to move rather than break if it is bumped, since it is held from vertically mounted hanger wires which may rotate to a certain extent with respect to the rack, permitting the rack to swing rather than break. The rack system is inexpensive, and capable of holding large loads.

DESCRIPTION OF THE INVENTION

This invention relates to a rack which comprises at least one wire mesh panel which, in turn, comprises a first array of parallel wires and a second array of parallel wires, both of the wire arrays being relatively stiff. The wires of the first and second arrays are in transverse, angular relation, being bonded to each other at at least a substantial number of wire crossing points, by welding or the like.

The wire mesh panel defines opposed, parallel side edges which are substantially defined by first individual wires of the first array. Third wires are respectively bonded to the panel, being positioned parallel to and adjacent to the first individual wires of the first array, i.e., those individual wires that define the opposed, parallel side edges. The third wires are spaced from the first individual wires by crossing wires of the second array.

Thus, the opposed, parallel side edges of the wire mesh panel which comprises the rack are generally defined by a pair of parallel wires comprising a first individual wire and a third wire, separated by the second array of wires, typically the ends of the wires of the second array.

Often, a plurality of the wire mesh panels described above may be connected together along their opposed parallel side edges by a plurality of clamp members. These clamp members respectively enclose the first individual wires of the first array and the adjacent third wires, to provide extra strength to the connection. The clamp members may retain a hanger wire, which hanger wire is positioned below the wires of the second array, parallel to the wires of the first array. The hanger wire extends substantially the length of the wire mesh panel, parallel to the opposed, parallel side edges. Each end of the hanger wire preferably defines a transversely extending wire portion terminating in a hanger hook, to permit hanging from a ceiling, typically a rafter which defines the ceiling and may also support a solid, horizontal ceiling if desired. Preferably, several such hanger wires are present, one on each side of the wire mesh panel or preferably an array of connected wire mesh panels.

It is also preferable for the clamp members to each comprise a first member which is substantially U-shaped in cross section, and a separate, second member which is substantially S-shaped in cross section. The first and second members are bolted together. Each of the S-shaped members defines a trough which receives a hanger wire, described above, in a position below the wires of the second array and parallel to the wires of the first array. Thus, each of the hanger wires may support the wires of the second array from the bottom if desired. Alternatively, heads of the bolts which hold the first and second members of the clamp member together may engage and prevent the hanger wire members from rising out of the trough when the wire mesh rack is supported by the hanger members. Also, the clamp members may surround and secure a pair of the opposed, parallel side edges of adjacent wire mesh panels, thus enclosing a first individual wire and a third wire of each of the panels for strong securence together of the respective wire mesh panels, to form a modular rack comprising two or more of such wire mesh panels connected together.

Thus the vertically mounted rack of this invention can be hung from brackets on rafters, or other elevated sites, being quite forgiving relative as to precise spacing of the brackets, and being capable of a measure of movement if bumped so that the rack swings rather than breaking in such a circumstance. This provides a new and useful rack for garages, workshops, and other indoor areas for added storage space, while the rack is relatively light and of simple, inexpensive construction, as well as being of variable size.

DESCRIPTION OF SPECIFIC EMBODIMENTS

Figures 1, 2, 3, 4:
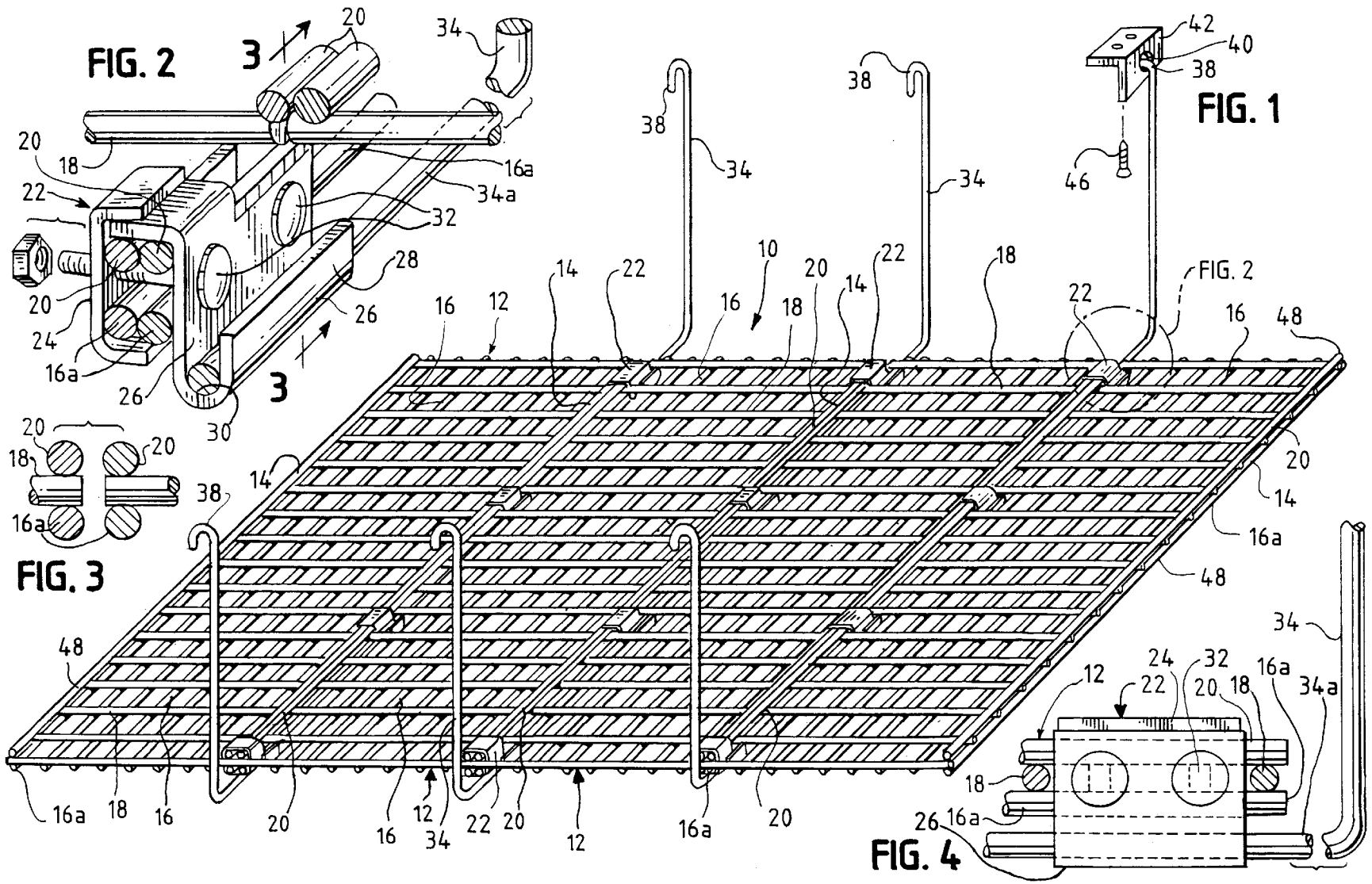
FIG. 1 is a perspective view of one embodiment of a rack of this invention, comprising four connected wire mesh panels, with certain portions eliminated for clarity.
FIG. 2 is an enlarged, fragmentary perspective view of a portion of the rack of FIG. 1, as indicated in FIG. 1.
FIG. 3 is a simplified, fragmentary vertical section showing pairs of first and second individual wires and third wires of respective parallel side edges of two wire mesh panels, enclosed by the clamp member of this invention.
FIG. 4 is a fragmentary side elevational view of the structure of FIG. 2, taken from the right side as shown in FIG. 2.

Referring to the drawings, a modular rack 10 is shown, being made up of several wire mesh panels 12, which are secured together at respective opposed, parallel side edges 14.

Each wire mesh panel comprises a first array of parallel wires 16 and a second array of parallel wires 18. The respective wires of the first and second arrays 16, 18 are seen to be substantially perpendicular to each other, although, if desired, other angles such as 45° or 60° may be used. The wires of the respective first and second arrays 16, 18 may be bonded to each other by conventional welding at least at a substantial number of wire crossing points.

The respective wires of arrays 16, 18, have a diameter, for example, of about a quarter inch each, to be stiff and strong.

In accordance with this invention, third wires 20 are respectively bonded to the panel at crossing second wires 18, the third wires being positioned parallel to and adjacent to the first individual wires 16*a* of the first array, being typically positioned at the edge of each panel along with first individual wires 16*a* of the first array. This defines the side edges 14 along with third wires 20 in this embodiment. This can be seen in FIG. 3, for example, in which the opposed, parallel side edges of joined panels are defined by a first individual wire 16*a* of the panel's first array 16 and a parallel third wire 20, the respective wires 16*a,* 20 being separated by the crossing wires of the second wire array 18.

The respective wire mesh panels 12 are connected together in this manner along the opposed parallel side edges defined by wires 16*a,* 20 by several spaced clamp members 22, which hold the respective panels together, enclosing respective third wires 20 and first individual wires 16*a* of the pair of wire mesh panels together in the clamp 22 in a generally rectangular array, with each of the wires 20 of adjacent panels being separated from wires 16*a* by the perpendicular wires of the second array 18. This provides a strong, secure connection between the respective wire mesh panels 12, with the panel edges defined by wires 20, 16*a* having substantially increased strength because of the extra wire 20.

Each of the respective clamp members 22 comprise a first member 24 which is substantially U-shaped in cross section (FIG. 2) and a second member 26, which is substantially S-shaped in cross section, with one end being extended parallel to the central portion of the S-shaped cross section so that the extended end 28 defines a trough 30. First and second members 24, 26 are bolted together with bolts 32 into the configuration as shown in FIG. 2. In this configuration, the respective sides of two wire mesh panels are held together by the clamping of their respective first individual wires 16*a* and the third wires 20, the wires being held in a cross-sectional rectangular array, with wires 20 being spaced from wires 16*a* by the wires of second array 18.

Trough 30, defined by S-shaped second member 26, carries a horizontal portion 34*a* of a hanger wire 34 in a position below the wires of second array 18. The section of hanger wire 34 which occupies trough 30 is parallel to the wires of first array 16, 16*a*.

Each of hanger wires 34 carries a hook 38 at its outer end, which hook can engage an aperture 40 of a bracket 42, which bracket may be mounted on a rafter or other solid site for mounting above the rack 12. While not shown for clarity, each of hooks 38 may connect to a separate attached bracket 42, which brackets may be mounted by screws 46 in a conventional manner. Because of the inherent flexibility of hanger wires 34, the placement of brackets 40 along a rafter or other attachment site is not very critical, so that the rack 12 of this invention can be easily installed. Also, if rack 12 is struck by the top of a moving vehicle, its tendency is more to swing and bend rather than to break, while retaining the load carried on the rack.

The horizontal section 34*a* of hanger wire 34 may rest underneath the wires of second array 18 in load carrying manner. Alternatively, the heads of bolts 32 and the width of extended portion 28 of second clamp section 26 may retain the horizontal portions 34*a* of hanger wires 34 in spaced relation from second wire array 18, if desired, and either way, strong load-bearing characteristics can be achieved.

The respective side edges 48 of rack 12 will normally also be secured by clamp members 22 with an attached, retained hanger wire 34. But this structure is not shown for clarity of disclosure, so that the structure and relationship of wires 16*a*, 18, 20 can be clearly seen.

Thus, a modular rack 12 is disclosed, which may comprise one or any plural number of connected wire mesh panels 12, having attached hanger wires which may be connected at their outer ends through hooks 38 or the like to an upper attachment point, such as a ceiling, which term is intended to include open rafters or any other upper surface under a roof. The modular rack is inexpensive, very strong, easy to install, and resistant to damage by collision with the top of a moving vehicle or the like.

The above has been offered for illustrative purposes only, and is not intended to limit the scope of the invention of this application, which is as described in the claims below.

What is claimed is:

1. A rack which comprises at least one wire mesh panel comprising a first array of parallel wires and a second array of parallel wires, the wires of the first and second arrays being in transverse, angular relation and being bonded to each other at least at a substantial number of wire crossing points, said panel defining opposed parallel side edges which are substantially defined by first individual wires of said first array, and third wires respectively bonded to said panel and positioned parallel and adjacent to said first individual wires of the first array, said third wires being spaced from said first individual wires by crossing wires of the second array, in which a plurality of said wire mesh panels are connected together along said opposed, parallel side edges by a plurality of clamp members, which respectively enclose said first individual wires of the first array and the adjacent third wires.

2. The rack of claim 1 in which said clamp members each comprise a first member of substantially U-shaped cross section, and a second member of substantially S-shaped cross section, said first and second members being secured together.

3. The rack of claim 2 in which each said S-shaped member defined a trough which receives a hanger wire in a position below said wires of the second array and parallel to the wires of the first array.

4. The rack of claim 3 in which each said hanger wire extends substantially the length of the adjacent wire mesh panel, each end of each hanger wire defining a transversely extending wire potion terminating in a hanger hook.

5. The rack of claim 1 in which hanger wires are positioned below the wires of the second array, parallel to the wires of the first array, each said hanger wire being secured to a plurality of said clamp members, each end of the hanger wire defining a transversely extending wire portion terminating in a hanger hook, to permit hanging from a site above the rack.

6. The rack of claim 1 in which a hanger wire is positioned below the wires of the second array, said hanger wire extending substantially from edge to edge of the adjacent wire mesh panel, each end of the hanger wire defining a transversely extending wire portion terminating in a hanger hook, to permit hanging from a site above the rack.

7. The rack of claim 1 in which said wires of the first and second array are substantially perpendicular to each other.

8. A modular rack which comprises a plurality of wire mesh panels held together at respective edges by a plurality of clamp members, and a plurality of hanger wires, each extending from edge to edge of said rack, said hanger wires being retained by the clamp members which connect said panel edges, said hanger wires having transversely extending wire portions at their respective ends, which portions terminate in a hanging hook to permit hanging of said rack from a site above the rack.

9. The modular rack of claim 8 in which said clamp members each comprise a first member of substantially U-shaped cross section, and a second member of substantially S-shaped cross section, said first and second members being secured together.

10. The rack of claim 9 in which said S-shaped member defines a trough which receives a said hanger wire in a position at least the top wires of the adjacent wire mesh panels.

11. A rack which comprises at least one wire mesh panel comprising a first array of parallel wires and a second array of parallel wires, the wires of the first and second arrays being in transverse, angular relation and being bonded to each other at least at a substantial number of wire crossing points, said panel defining opposed parallel side edges which are substantially defined by first individual wires of said first array, and third wires respectively bonded to said panel and positioned parallel and adjacent to said first individual wires of the first array, said third wires being spaced from said first individual wires by crossing wires of the second array, further in which a hanger wire is positioned below the wires of the second array, said hanger wire extending substantially from edge to edge of the adjacent wire mesh panel, each end of the hanger wire defining a transversely extending wire portion terminating in a hanger hook, to permit hanging from a site above the rack.

12. The rack of claim 11 in which a plurality of said wire mesh panels are connected along said opposed, parallel side edges by a plurality of clamp members, which respectively enclose said first individual wires of the first array and the adjacent third wires, in which said clamp members each comprise a first member of substantially U-shape cross section, and a second member of substantially S-shaped cross section, said first and second members being secured together.

13. The rack of claim 12 in which each S-shaped member defines a trough which receives said hanger wire in a position below said wires of the second array and parallel to the wire of the first way.

14. The rack of claim 11 in which said wires of the first and second array are substantially perpendicular to each other.

* * * * *

UNITED STATES PATENT AND TRADEMARK OFFICE

CERTIFICATE OF CORRECTION

PATENT NO. : 6,409,031 B1
DATED : June 25, 2002
INVENTOR(S) : Wynne, D.

It is certified that error appears in the above-identified patent and that said Letters Patent is hereby corrected as shown below:

Column 6,
Line 10, “way” should be -- array --.

Signed and Sealed this

Fourteenth Day of January, 2003

JAMES E. ROGAN
*Director of the United States Patent and Trademark Office*